US005129528A

United States Patent [19]

Eidsmoe et al.

[11] Patent Number: 5,129,528

[45] Date of Patent: Jul. 14, 1992

[54] MULTI-TIERED RACK FOR TOOLS

[75] Inventors: Jeffery J. Eidsmoe, El Paso County, Colo.; Stuart G. Demetre, New Haven County, Conn.

[73] Assignee: Emerson Electric Co., St. Louis, Mo.

[21] Appl. No.: 783,390

[22] Filed: Oct. 28, 1991

[51] Int. Cl.[5] ..... A47F 7/00

[52] U.S. Cl. ..... 211/70.6; 211/69

[58] Field of Search ..... 211/70.6, 60.1, 87, 211/106, 69

[56] References Cited

U.S. PATENT DOCUMENTS

| | | | |
|---|---|---|---|
| 2,815,863 | 12/1957 | Larson | 211/70.6 X |
| 2,855,107 | 10/1958 | Roth | 211/70.6 |
| 2,974,804 | 3/1961 | Maro | 211/70.6 |
| 3,269,550 | 8/1966 | Marcus | 211/70.6 X |
| 3,737,131 | 6/1973 | Larson | 211/70.6 X |
| 4,667,822 | 5/1987 | Coopmans | 211/70.6 X |
| 4,813,551 | 3/1989 | Kuo | 211/70.6 |
| 4,966,288 | 10/1990 | Kirkham | 211/60.1 |

*Primary Examiner*—Robert W. Gibson, Jr.

*Attorney, Agent, or Firm*—Polster, Lieder, Woodruff & Lucchesi

[57] ABSTRACT

A multi-tiered rack for tools is disclosed. The rack includes at least one stepped section or spaced upper and lower stepped sections each having interconnected alternating horizontal and vertical surfaces arranged in a stepped pattern. Structural connecting elements support the at least one stepped section or spaced upper and lower sections in the aforementioned stepped pattern. Where upper and lower stepped sections are used, each horizontal surface is aligned in substantially parallel relationship to a corresponding horizontal surface in the other of the upper and lower stepped sections. Similarly, each vertical surface in one of the upper and lower stepped sections is in generally aligned coplanar relationship with a corresponding vertical surface in the other of the upper and lower stepped sections. In order to support tools, tool supporting means such as tool openings are formed in the horizontal surfaces of at least the upper, and preferably both the upper and lower horizontal surfaces of the upper and lower stepped sections for receiving tools to support same in the multi-tiered rack. Where only one stepped section is used, tools are supported by the rack, but rest on a supporting surface which also supports the rack.

18 Claims, 8 Drawing Sheets

MULTI-TIERED RACK FOR TOOLS

CROSS REFERENCE TO RELATED APPLICATION

This application relates to a copending design patent application Ser. No. 07/784,056, filed on an even date herewith, also entitled MULTI-TIERED RACK FOR TOOLS.

BACKGROUND OF THE INVENTION

The present invention relates to a multi-tiered rack for tools, and more particularly, to a multi-tiered rack including spaced upper and lower stepped sections with suitable corresponding tool openings formed in each section for supporting and displaying tools for consumer purchase.

For displaying tools such as screw drivers, pliers and the like in retail stores, suitable merchandising support devices have been developed. These typically include peg board type hooks, supporting rods, supporting bars and the like for supporting such tools, primarily through packaging, at least partially containing such tools. The packaging is provided with a hole or slot that is capable of being mounted over a peg board type hook or supporting rod. A typical example is shown in U.S. Pat. No. 3,677,415 in which there is disclosed a supporting plate with upper and lower wires suitably formed for extending through a peg board panel or the like, the mounting plate also having one or more rods or bars extending generally transversely therefrom, for receiving a hole or slot provided in the packaging which at least partially surrounds a tool.

While such aforementioned merchandising supporting devices have been usefully employed for merchandising tools to customers, it has been discovered that new and improved multi-tiered racks for tools, as disclosed herein, provide a new and unique tool support and merchandising device, which also eliminates the need for any packaging whatsoever in supporting the tool relative to the tool support and merchandising device.

SUMMARY OF THE INVENTION

Among the several objects and advantages of the present invention include:

The provision of a multi-tiered rack for tools which overcomes the aforementioned deficiencies of the prior art;

The provision of the aforementioned multi-tiered rack for tools which is constructed to provide a unique tool support and merchandising device, that is mounted with respect to a peg board or the like, for a plurality of closely positioned tools contained therein;

The provision of the aforementioned multi-tiered rack for tools which includes spaced upper and lower stepped sections each including interconnected alternating horizontal and vertical surfaces arranged in a stepped pattern, and including tool openings formed in at least the upper horizontal surface, for supporting tools in a convenient and accessible merchandising and display arrangement;

The provision of the aforementioned multi-tiered rack for tools which can be constructed in a variety of shapes and sizes, including different tool supporting means including openings, pins, etc. for one or more tools, as desired;

The provision of the aforementioned multi-tiered rack for tools in which the spaced upper and lower stepped sections are structurally connected to one another by suitable structural supports in the aforementioned stepped pattern;

The provision of the aforementioned multi-tiered rack for tools which requires no packaging for the tools, in order to support same in the multi-tiered rack, for display and merchandising purposes; and The provision of the aforementioned multi-tiered rack for tools which is simple and easy to construct and use, is readily adaptable to existing peg board panels or the like; is long wearing and durable; and is otherwise well adapted for the purposes intended.

Briefly stated, the multi-tiered rack for tools of the present invention includes spaced upper and lower stepped sections each including interconnected alternating horizontal and vertical surfaces arranged in a stepped pattern. Structural connecting means support the spaced upper and lower sections in the aforementioned stepped pattern. Each horizontal surface in one of the upper and lower stepped sections is formed in aligned and substantially parallel relationship to a corresponding horizontal surface in the other of the upper and lower stepped sections. Each vertical surface in one of the upper and lower stepped section is in generally aligned coplanar relationship with a corresponding vertical surface in the other of the upper and lower stepped sections. To support tools in the multi-tiered rack, tool openings are formed or upstanding pins are provided in the horizontal surfaces of at least the upper horizontal surfaces of the upper and lower stepped sections for receiving tools therein to support same in the multi-tiered rack.

The tool openings are preferably formed in the horizontal surfaces of both the upper and lower stepped sections. Each of the tool openings in the aligned and substantially parallel upper and horizontal surfaces are also in substantial register with one another. Each opening that is in substantial register with one another in the upper and lower stepped sections may have the same or different size and shape. There may be only one or a plurality of tool openings formed in each aligned and substantially parallel upper and lower horizontal surface. Where there are a plurality of openings in upper and lower horizontal surfaces, they are all constructed in substantial register with one another.

The structural connecting means includes spaced wire elements which are joined to at least some of the interconnected alternating horizontal and vertical surfaces in each of the upper and lower stepped sections for supporting same in fixed relationship to one another. The space wire elements are joined to the upper and lower stepped sections at opposite ends thereof. The spaced wire elements each include a generally horizontally extending portion and upwardly extending portions at the ends thereof for attachment to aligned horizontal surfaces in the upper and lower sections at one end and to generally vertically aligned surfaces in the upper and lower sections at an opposite end thereof.

The multi-tiered rack includes means for attaching same to a display board, such as a peg board panel or the like. The attaching means is preferably mounted to a generally vertically oriented rear surface which is connected to and extends transverse to the uppermost horizontal surfaces in the upper and lower stepped sections. The attaching means includes at least one display board fastening element for releasable attachment thereto. If desired, upper and lower display board fastening elements may be provided.

These and other objects and advantages of the present invention will become apparent from the description that is to follow.

BRIEF DESCRIPTION OF THE DRAWINGS

In the drawings.

FIG. 12 is a fragmentary side elevational view illustrating one type of panel mounting means for use with the multi-tiered rack for tools as shown in FIG. 1;

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

FIGS. 1–6 and 13–18 of the drawings show several different embodiments of the multi-tiered rack for tools which disclose the features of the present invention. FIGS. 7–12 disclose various top, bottom, side and end views of the multi-tiered rack for tools illustrated in FIG. 1 of the drawings. It is believed unnecessary to disclose, in similar top, bottom, side and end views, the other embodiments shown in FIGS. 2–6 and 13–18 of the drawings since they are, for the most part, the same, except for size, shape, hole configuration, etc. In any event, reference is made to Applicants' aforementioned copending design application which discloses the top, bottom, side and end views of each of the embodiments shown in FIG. 1–6 and 13–18 of the drawings, should it be necessary to refer to same for any purpose. For ease of understanding; however, it is believed necessary to only provide the top, bottom, side and end views shown in FIGS. 7–12 as related to the FIG. 1 embodiment, in order to understand the teachings of the present invention.

Figure 1:
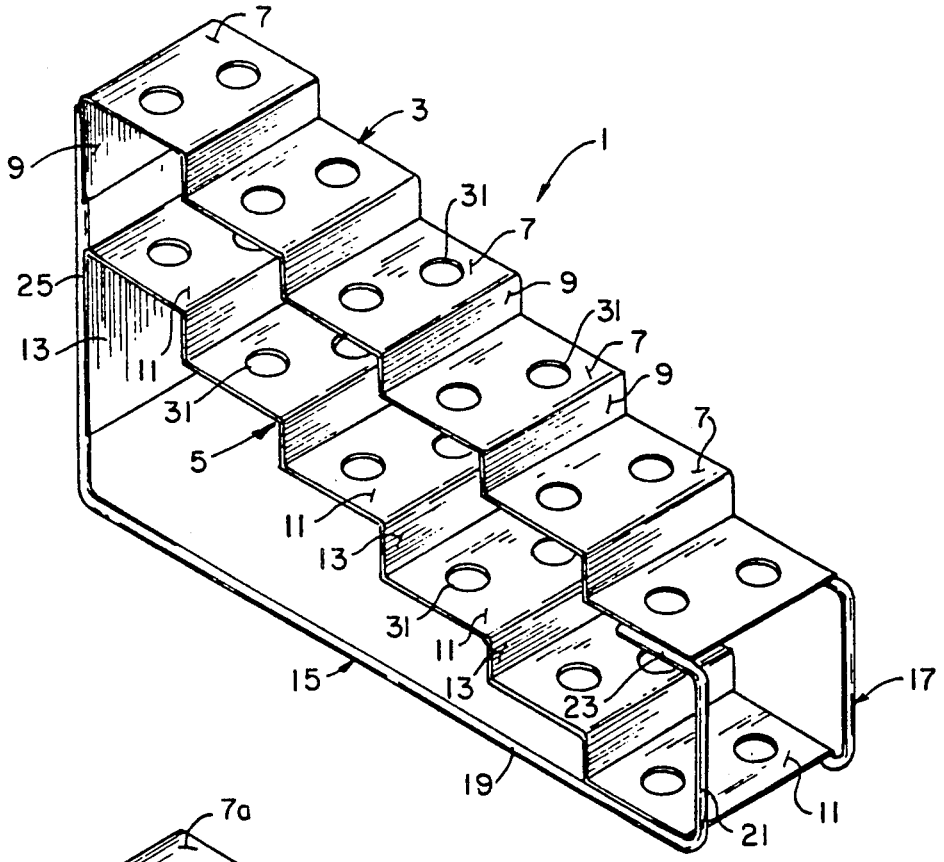
FIG. 1 is a side top perspective view of one form of multi-tiered rack for tools constructed in accordance with the teachings of the present invention.

Referring now to the FIG. 1 embodiment, including the top, bottom, side and end views shown in FIGS. 7–12 of the drawings, it will be appreciated that the multi-tiered rack for tools of the present invention 1 is shown as including spaced upper and lower stepped sections 3, 5, respectively, each including interconnected alternating horizontal and vertical surfaces arranged in a stepped pattern. Specifically, the alternating horizontal and vertical surfaces in the upper stepped section are identified as 7, 9, respectively. In the lower stepped section 5, the alternating horizontal and vertical surfaces are identified as 11, 13, respectively.

Figure 9:
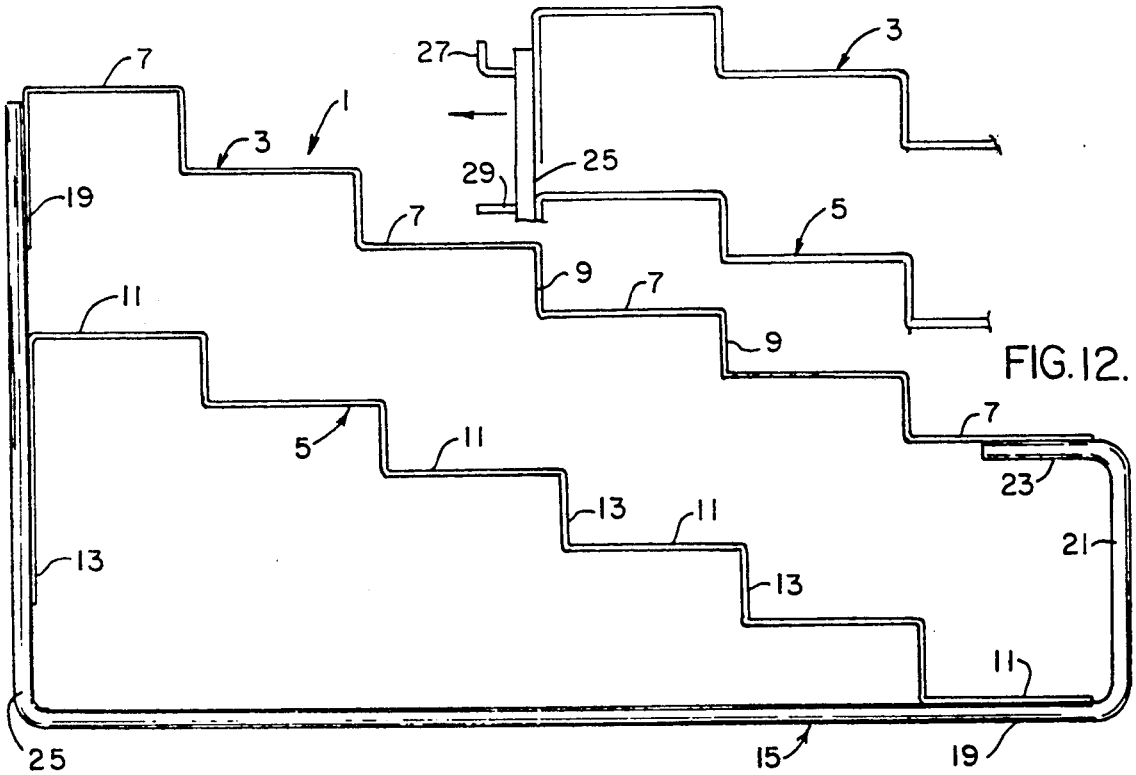
FIG. 9 is a side elevational view of the multi-tiered rack for tools illustrated in FIG. 1.
Figure 10:
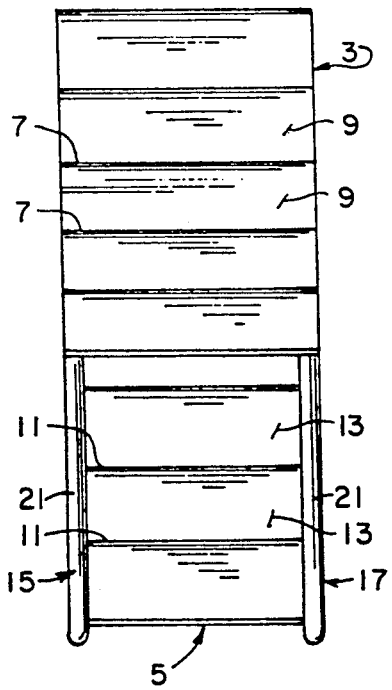
FIG 10 is a front end view of the multi-tiered rack for tools shown in FIG. 1.

The multi-tiered rack 1 is constructed such that each horizontal surface 7, 11 in one of the upper and lower stepped sections 3, 5 are in aligned and substantially parallel relationship to each other, as best shown in FIG. 9 of the drawings. Also as shown in FIG. 9 of the drawings, each vertical surface 9 or 13 in one of the upper and lower stepped sections 3, 5 is in generally aligned coplanar relationship with the corresponding vertical surface in the other of the upper and lower stepped sections 3,5.

For structurally interconnecting the spaced upper and lower sections in the aforementioned stepped pattern, structural connecting means in the form of spaced wire element 15, 17 are joined to at least some of the interconnected alternating horizontal and vertical surfaces in each of the upper and lower step sections 3, 5 for supporting them in fixed relationship to one another. As shown in FIGS. 1 and 7–11 of the drawings, the spaced wire elements 15, 17 are joined to the upper and lower step sections at opposite ends thereof.

Figure 11:
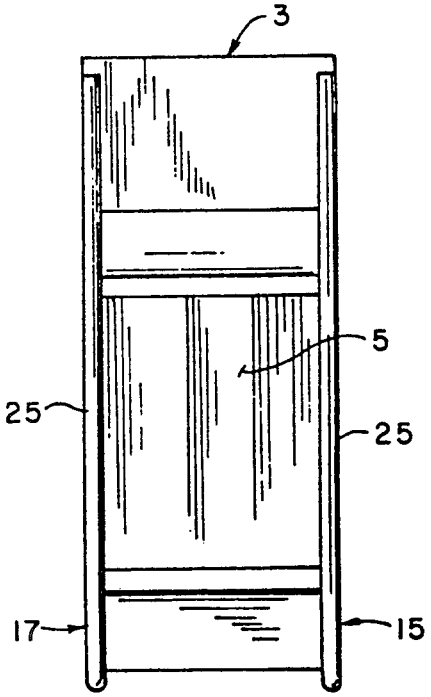
FIG. 11 is a rear end view of the multi-tiered rack for tools shown in FIG. 1.

Each spaced wire element 15, 17 is constructed the same, and therefore, the description of one will also describe the other. Referring to the spaced wire element 15, there is a generally horizontally extending portion 19 which has a length generally corresponding to the length of each of the upper and lower stepped sections 3, 5, and upwardly extending portions at free ends thereof. At one free end, there is an upwardly extending portion 21 which is also reversely bent at 23, as best shown in FIGS. 1 and 9 of the drawings. In the upper and lower stepped sections 3, 5, the lowermost horizontal aligned and parallel surfaces 7, 11, thereof are attached to the horizontally extending portion 19 and the reversely bent portion 23, by welding or other suitable fastening technique. Extending downwardly from the uppermost horizontal substantially parallel surfaces 7, 11 in the spaced upper and lower sections 3, 5 are a pair of aligned vertical surfaces 9, 13 which are attached by welding or other suitable method to an upwardly extending portion 25, as best seen in FIGS. 1, 9 and 11 of the drawings. Note that the attached vertically aligned surfaces 9, 13 secured to the upwardly extending portion 25 of the wire element 15 are substantially longer in length and form downwardly extending vertical surfaces extending from the uppermost portion of the upper and lower stepped sections 3, 5. For mounting the multi-tiered rack for tools 1 to a peg board panel or the like, suitable attachment or mounting hooks and rods, 27, 29 respectively, may be secured to the upwardly extending portion 25 of the wire element 15, for mounting to a peg board panel or the like. Alternatively, the cooperating pairs of upper hooks 27 and lower rods 29, extending from each of the upwardly extending portions 25 of each wire element 15, 17 may be mounted to a plate or other supporting surface, such as shown in U.S. Pat. No. 3,677,415, if desired. Various other mounting techniques for securing the multi-tiered rack for tools to a peg board or the like could also be used, if desired.

In order to mount tools in the multi-tiered rack 1, tool openings are formed in the horizontal surfaces 7 of at least the upper horizontal surfaces 7 of the upper and lower stepped sections 3, 5. Preferably, however, tool openings 31 are formed in the aligned and substantially parallel upper and lower horizontal surfaces 7, 11 of the upper and lower stepped sections 3, 5.

Figure 5:
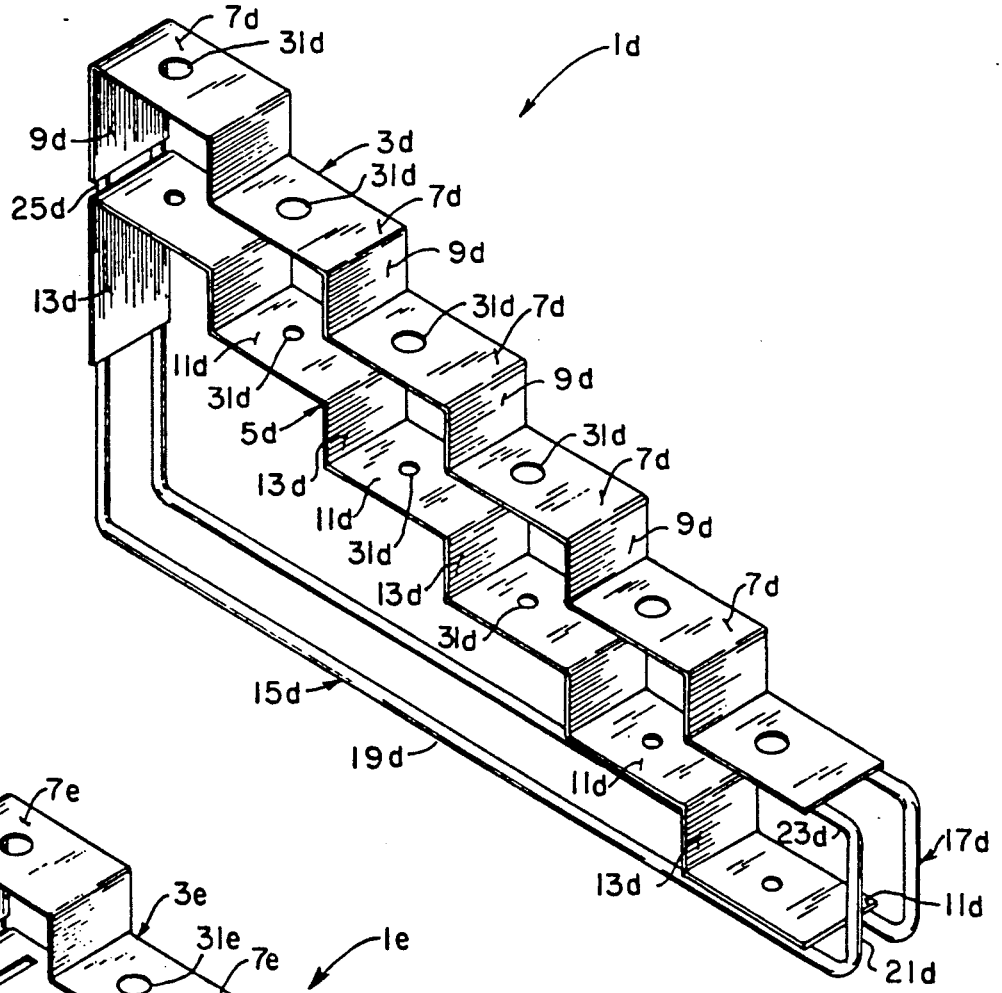
FIG. 5 is a side top perspective view of still another modified form of multi-tiered rack for tools.
Figure 6:
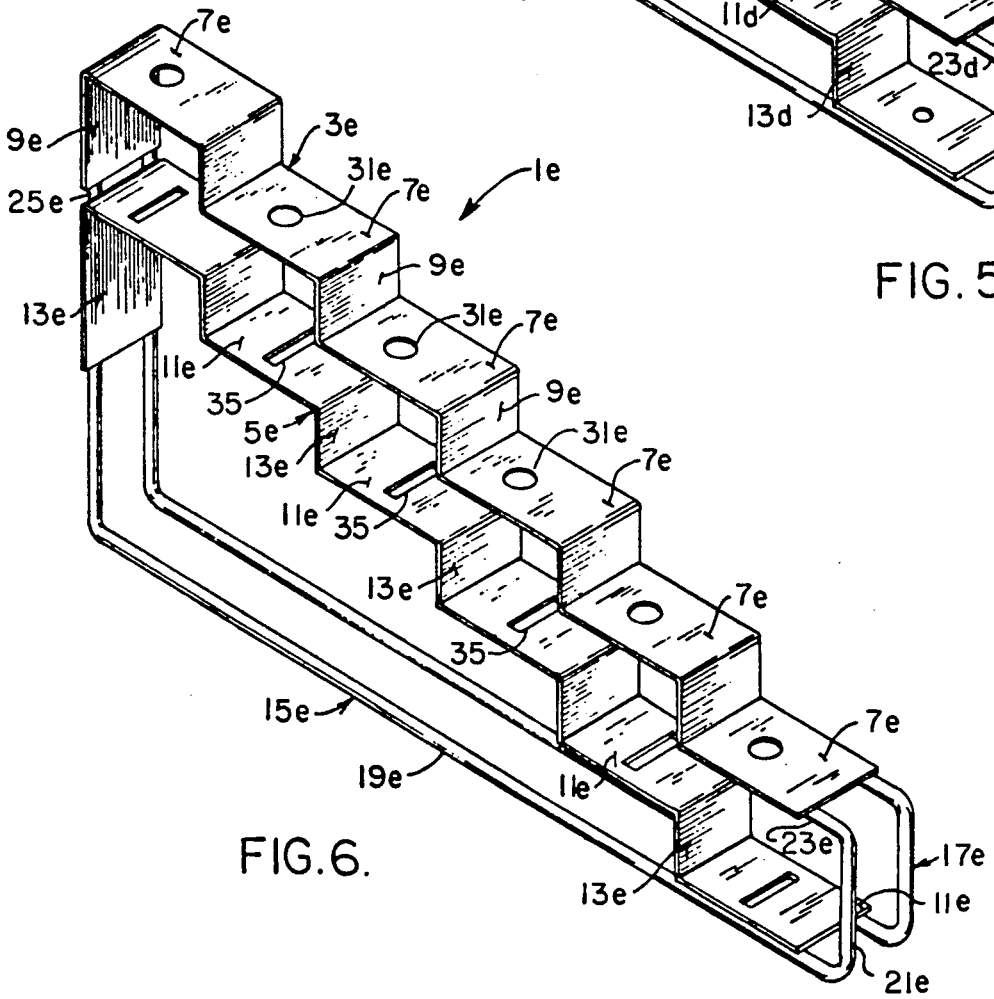
FIG. 6 is a side top perspective view of still a further form of multi-tiered rack for tools.
Figure 7:
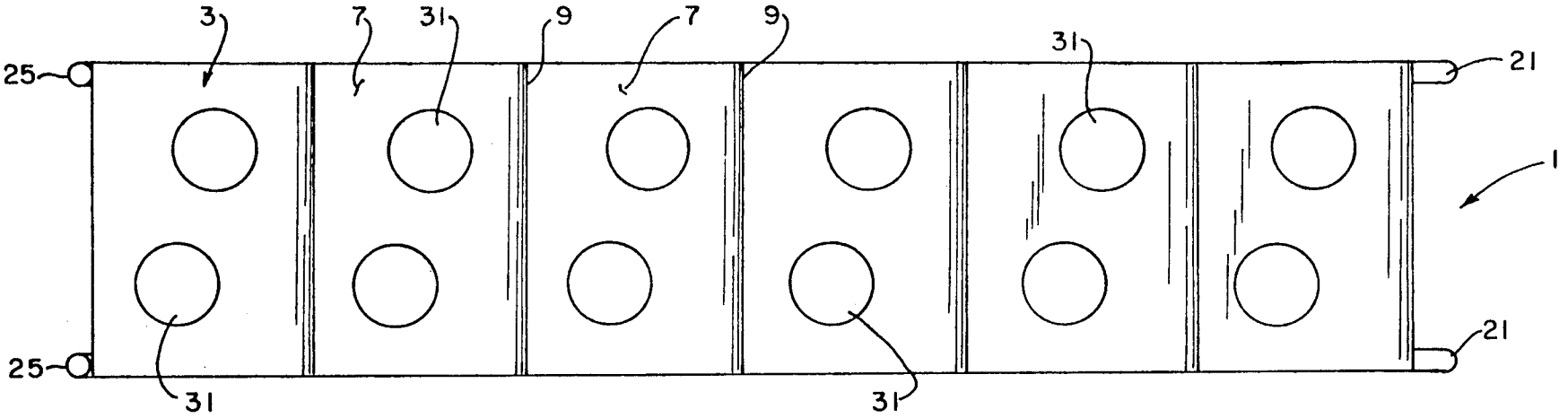
FIG. 7 is a top plan view of the multi-tiered rack for tools disclosed in FIG. 1.
Figure 8:
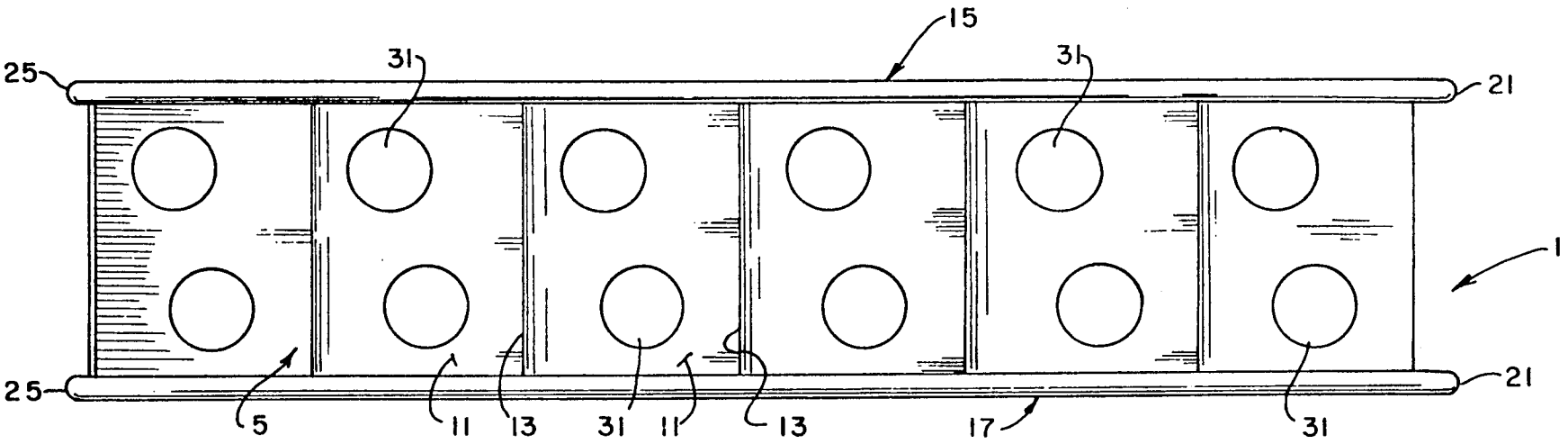
FIG. 8 is a bottom plan view of the multi-tiered rack for tools shown in FIG. 1.

While there may be only a single tool opening provided in the upper and lower aligned and substantially parallel horizontal surfaces 7, as shown in FIGS. 5–6, for example, the FIG. 1 embodiment shows a pair of offset tool openings 31 formed in each of the aligned and substantially parallel upper and lower horizontal surfaces 7, 11 of the upper and lower stepped sections 3, 5. Each of the tool openings 31, 31 in each upper horizontal surface 7 is in substantial register with the tool openings 31, 31 in a lower aligned and substantially parallel horizontal surface 7 and, in the FIG. 1 embodiment, are shown to be of the same general size and shape.

For mounting a tool such as a screw driver, pliers in the multi-tiered rack for tools 1, a store employee can simply insert the appropriate elements of the tool into the aligned openings 31, in the upper and lower stepped sections, for readily mounting the tool in a easily observable, displayed position. It is unnecessary to use any packaging for mounting the tools since the plier handles and/or the screw driver point may be simply inserted through the aligned tool openings 31 in the upper and lower step sections 3, 5. However, a suitable label, with a universal product code (UPC) designation is preferably applied directly to the tool itself, thus enabling the store employee to check-out the goods for purchase by simply positioning the UPC fixed label relative to an electronic scanner device (not shown) for obtaining the proper code, dollar amount, ect. By eliminating the need for packaging, suitable savings are achieved, not only in the cost of packaging itself, but also in the cost of disposal. Thus, the multi-tiered rack for tools 1 of the present invention provides a number of additional not readily apparent advantages, for merchandising and display of tools.

In each of the FIGS. 2–6 and 13–18 embodiments, corresponding reference numerals have been employed with the suffix "a" through "k" used in the various embodiments to designate like parts.

Figure 2:
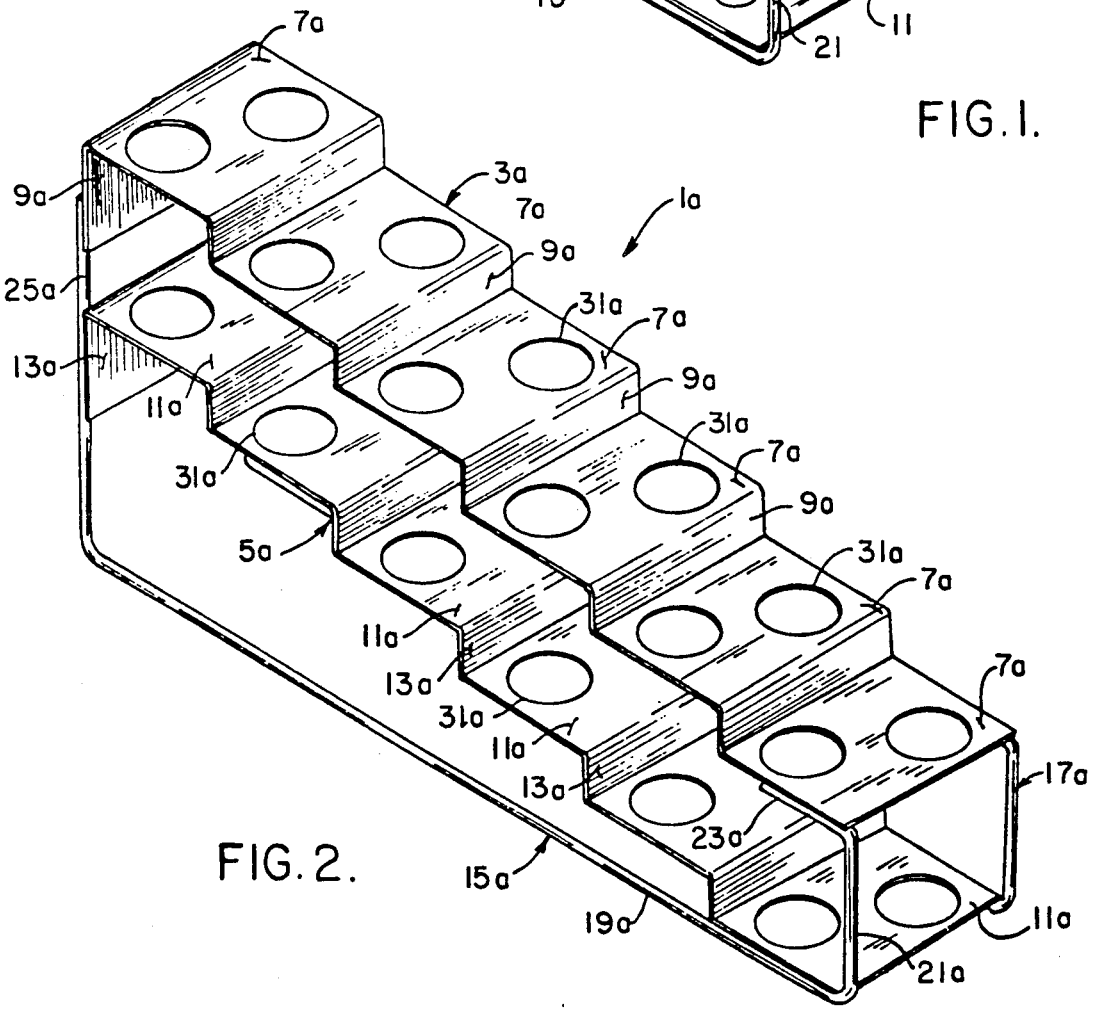
FIG. 2 is a side top perspective view of a modified form of multi-tiered rack for tools.

In the FIG. 2 embodiment, the multi-tiered rack for tools 1*a* is substantially the same as the FIG. 1 embodiment with the exception of the size of the components including the upper and lower horizontal and vertical surfaces 7*a*, 11*a* and 9*a*, 13*a*, respectively, as well as the size of the tool openings 31*a*.

Figure 3:
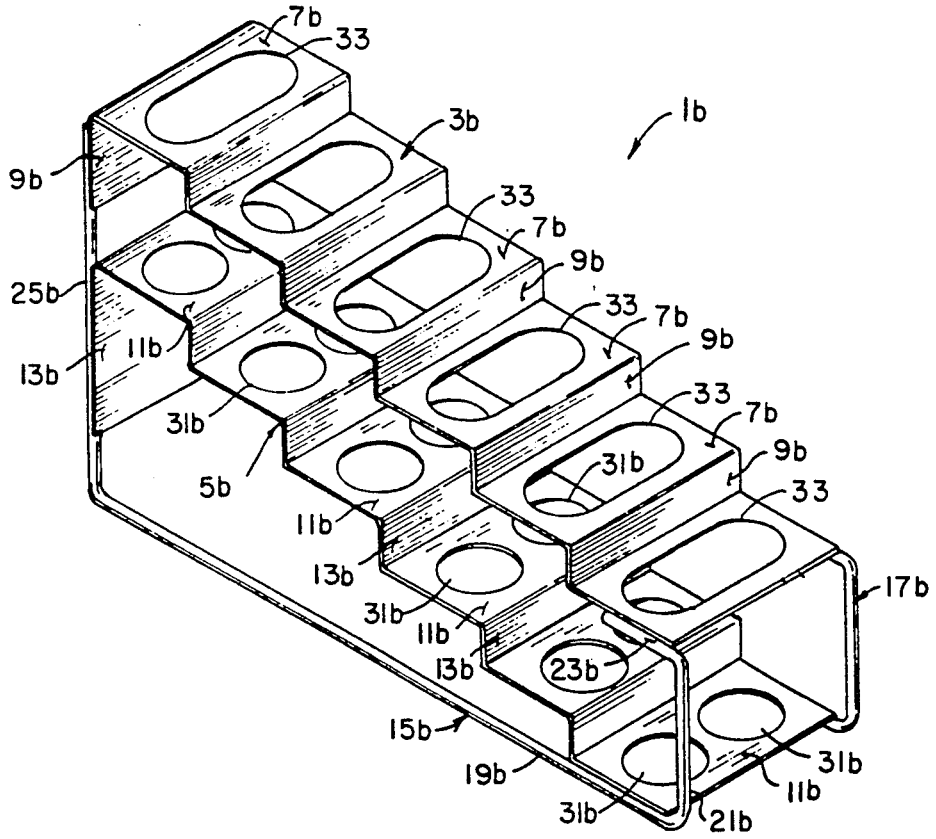
FIG. 3 is a side top perspective view of still another modified form of multi-tiered rack for tools.

In FIG. 3 of the drawings, the tool openings 33 of the upper horizontal surfaces 7*b* comprise an elongated slot 33 that is in substantial register with a pair of tool openings 31*b*, 31*b* in the lower horizontal surfaces.

Figure 4:
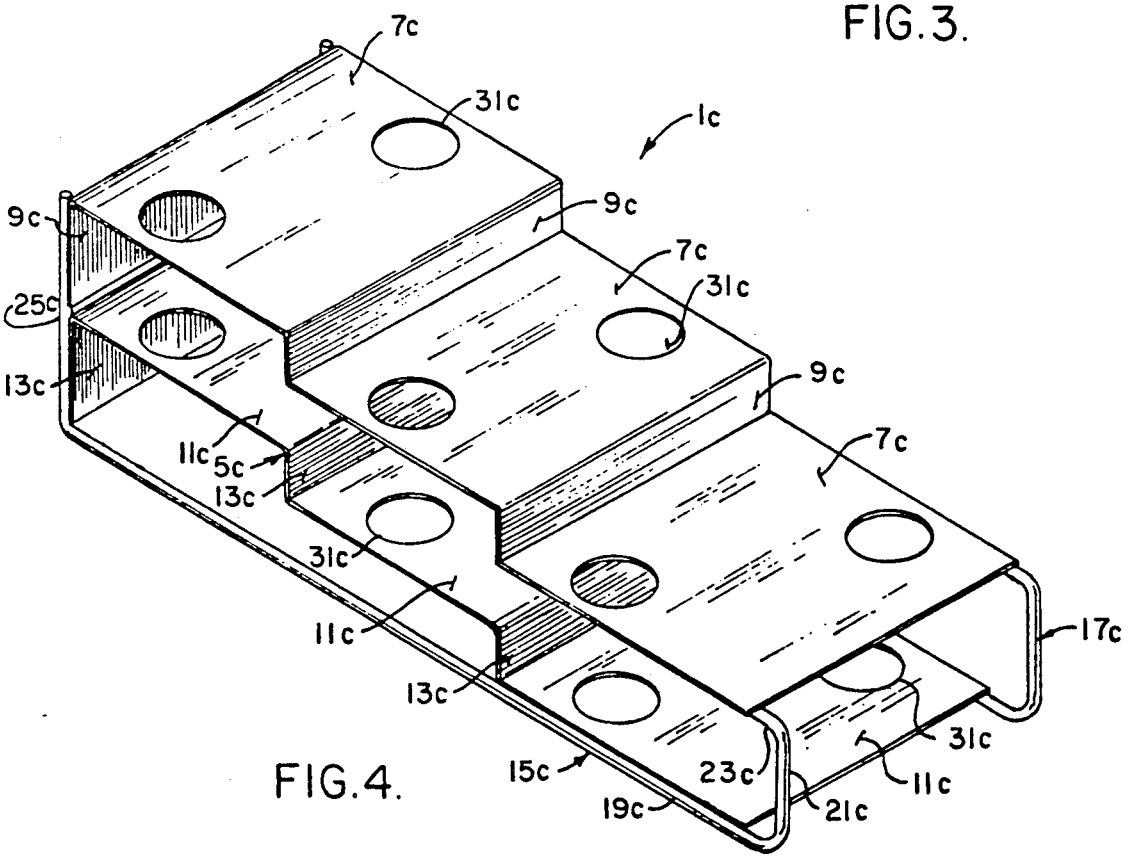
FIG. 4 is a side top perspective view of yet another form of multi-tiered rack for tools.

In the FIG. 4 embodiment, there are only 3 upper and lower horizontal surfaces 7*c*, 11*c* because the size of such surfaces are substantially larger than in the other embodiments. Despite the larger size of such upper and lower horizontal surfaces 7*c*, 11*c*, the tool openings 31*c*, 31*c* in each upper and lower horizontal surface 7*c*, 11*c* are, in relative terms, substantially smaller in size with respect to the size of the horizontal surfaces 7*c*, 11*c*.

In FIG. 5 of the drawings, the upper and lower tool openings 31*d*, 31*d* in the upper and lower horizontal surfaces 7*d*, 11*d*, while being in substantial register with one another, have a different diametrical opening. Specifically, the lower tool opening 31*d* formed in the lower horizontal surfaces 11*d* is substantially smaller than the tool opening 31*d* in the upper horizontal surfaces 70.

In the FIG. 6 embodiment, there is a tool opening 31*e* in each upper horizontal surface 7*e* which is in substantial register with an elongated rectangularly-shaped slot 35 formed in the lower horizontal surfaces 11*d*.

Figure 13:
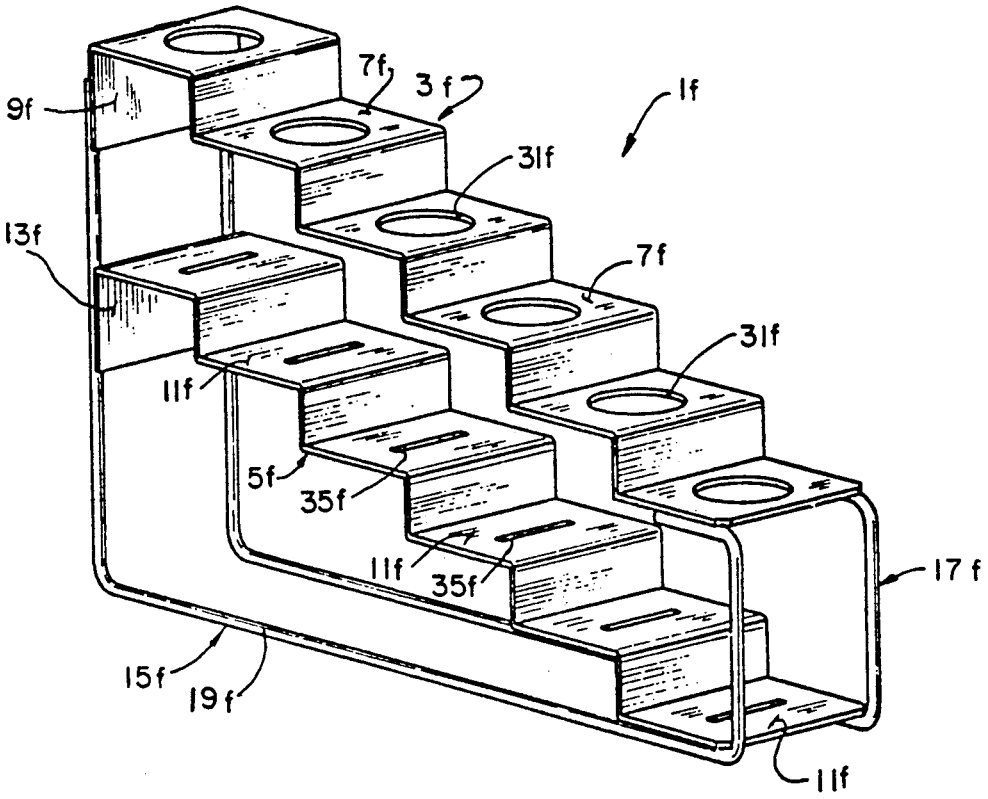
FIG. 13 is a side top perspective view of another modified form of multi-tiered rack for tools.

In FIG. 13 of the drawings, the construction is similar to FIG. 6 of the drawings, with the exception that openings and rectangular-shaped slots are larger. More specifically, it will be noted that the tool opening 31*f* in each upper horizontal surface 7*f* and the substantially in register elongated rectangular-shaped slot 35*f* in each lower horizontal surface 11*f* are larger in shape or size due to size of the upper and lower horizontal surfaces 7*f*, 11*f*, together with the shape or size of the openings and slots 31*f*, 35*f*, respectively.

Figure 14:
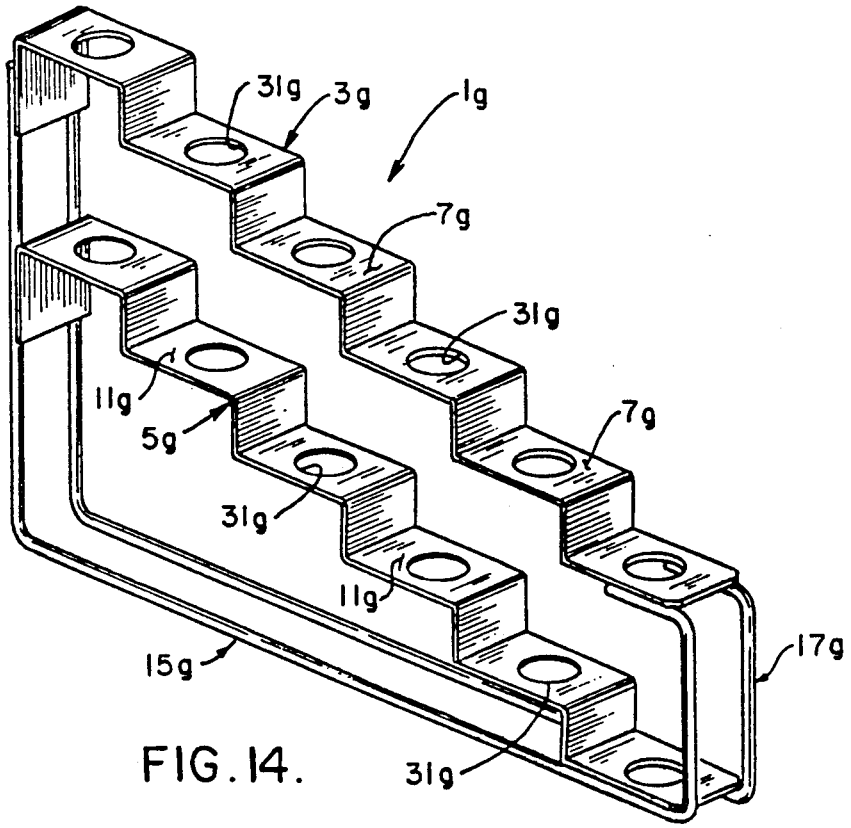
FIG. 14 is a side top perspective view of yet another modified form of multi-tiered rack for tools.

In the FIG. 14 embodiment, the construction is somewhat similar to the FIG. 5 embodiment, with the exception that the opening 31*g*, 31*g* in the upper and lower horizontal surfaces 7*g*, 11*g* are generally the same size whereas, in the FIG. 5 embodiment, the upper and lower openings have different sizes.

Figure 15:
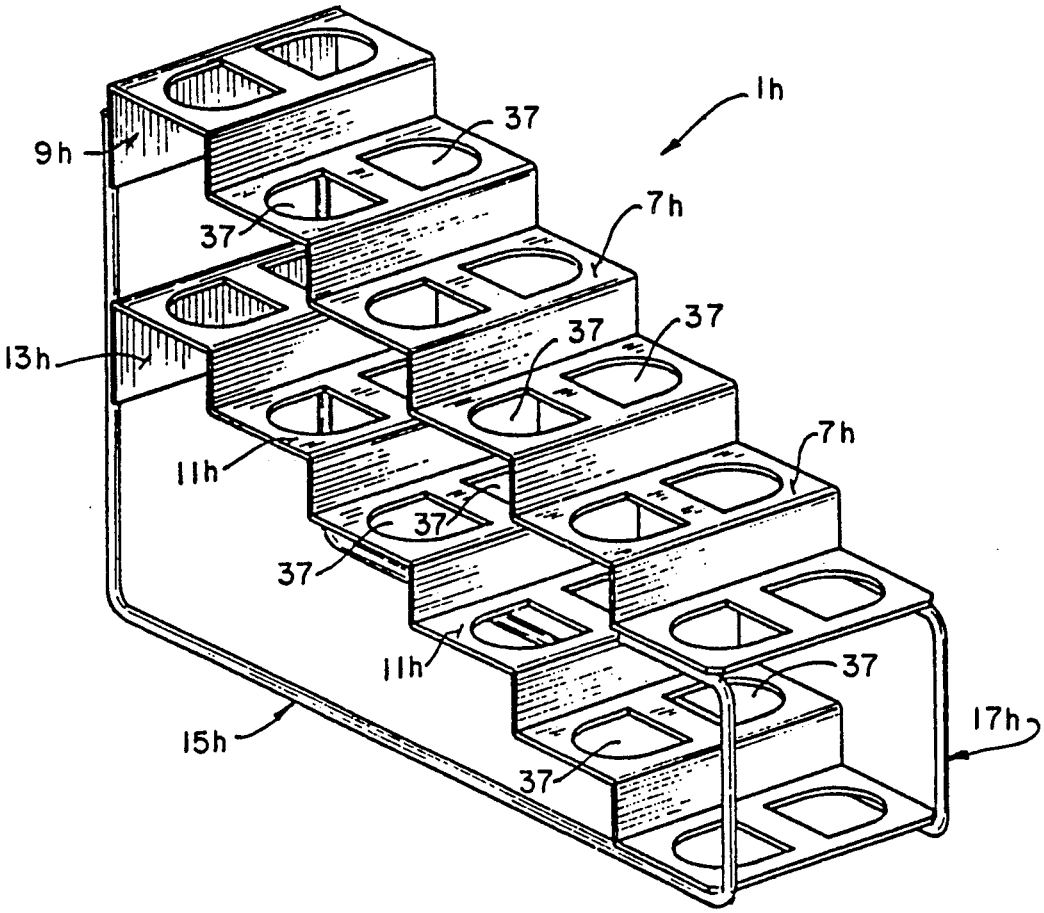
FIG. 15 is a side top perspective view of still another form multi-tiered rack for tools.

In the FIG. 15 embodiment, a pair of closed d-shaped openings 37, 37 are formed in each of the upper and lower horizontal surfaces 7*h*, 11*h*,, as shown. It will further be appreciated that the d-shaped openings 37, 37 in each of the upper horizontal surfaces 7*h* are in substantial register with the d-shaped openings 37, 37 in corresponding aligned lower horizontal surface 11*h*, as is illustrated.

Figure 16:
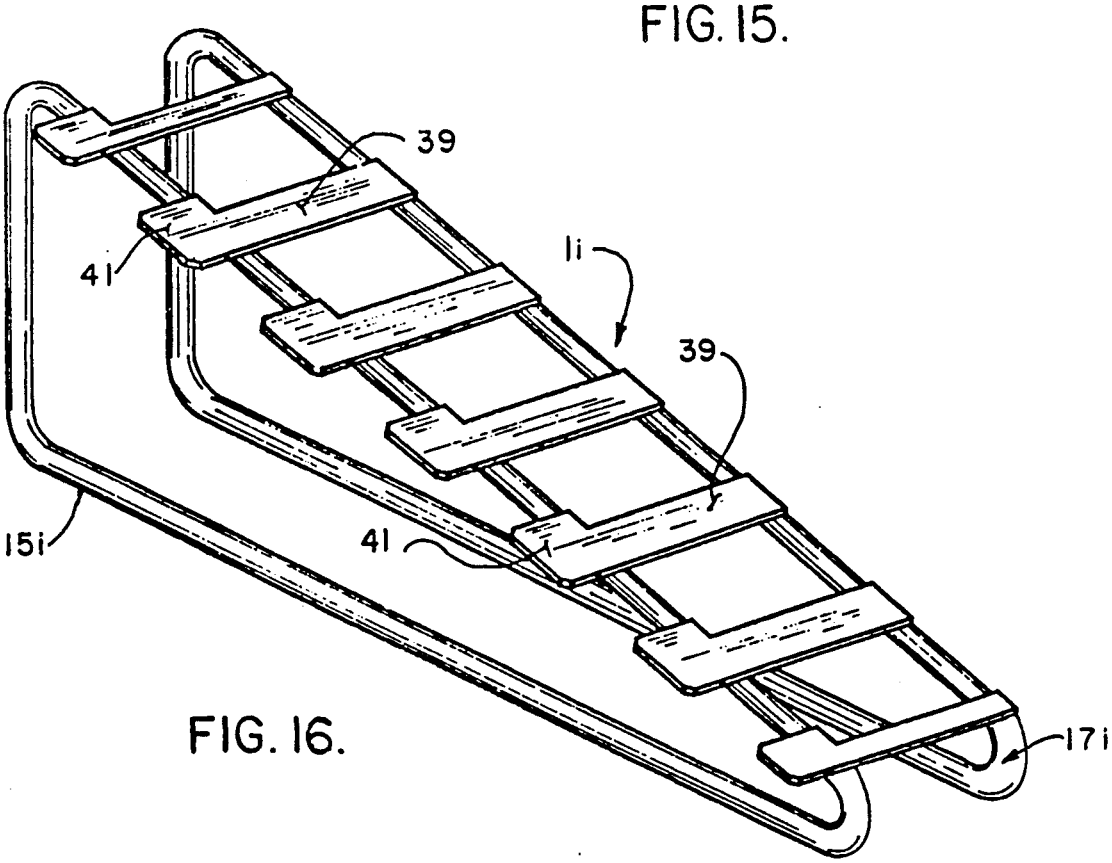
FIG. 16 is a side top perspective view of yet still another modified form of multi-tiered rack for tools.

In the FIG. 16 embodiment, a pair of wire elements 15*i*, 17*i* are geneally triangular shaped, as illustrated, while upper inclined portions of the wire elements 15*i*, 17*i* are connected through step-ladder shaped struts 39, each having a foot 41 at one end thereof. Note further that the horizontally extending wire portions of the wire elements 15*i*, 17*i* do not have corresponding step ladder shaped struts 39, but are unconnected as illustrated.

Figure 17:
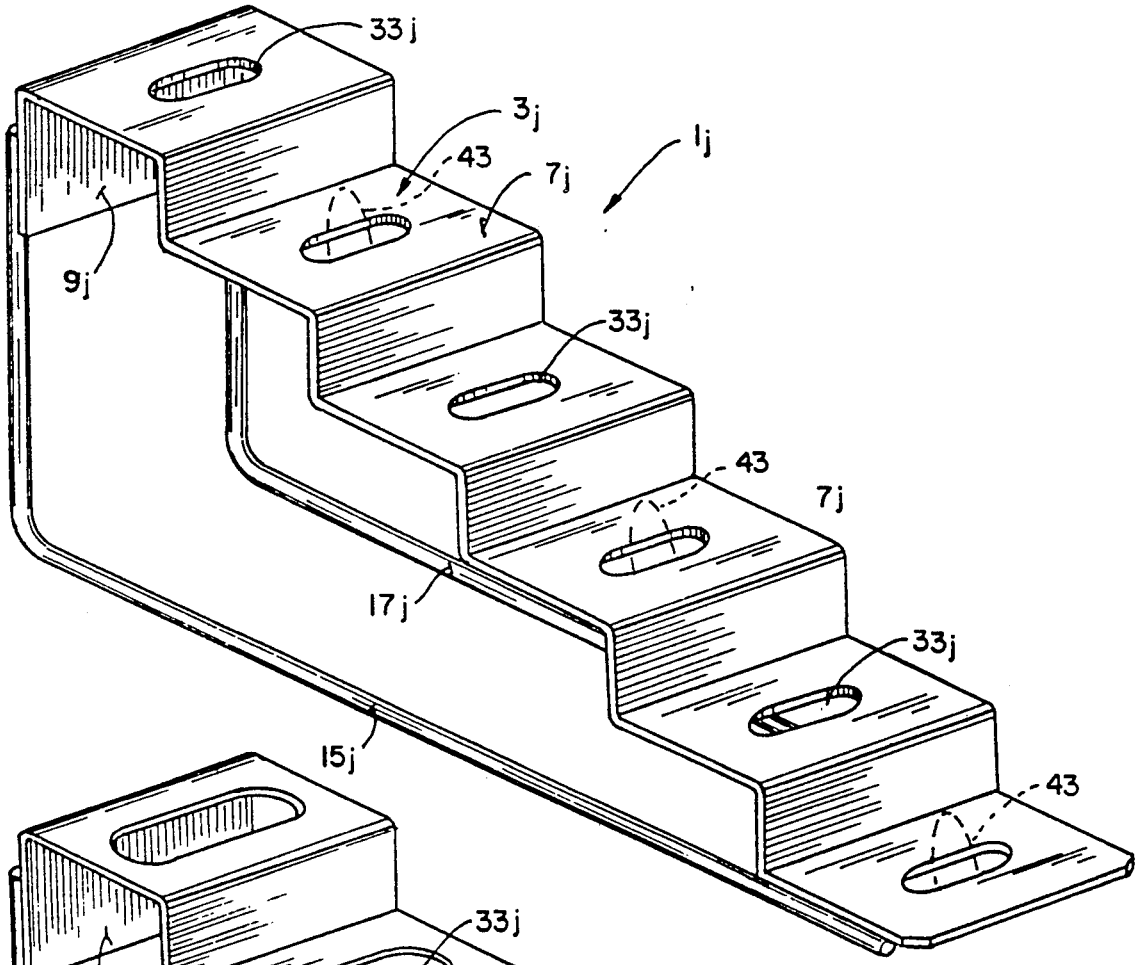
FIG. 17 is a side top perspective view of still a further modified form of multi-tiered rack for tools.

In the FIG. 17 embodiment, the rack 1*j* includes a single upper stepped section 3J with elongated openings 33*j* formed in the horizontal surfaces 7*j* thereof.

Figure 18:
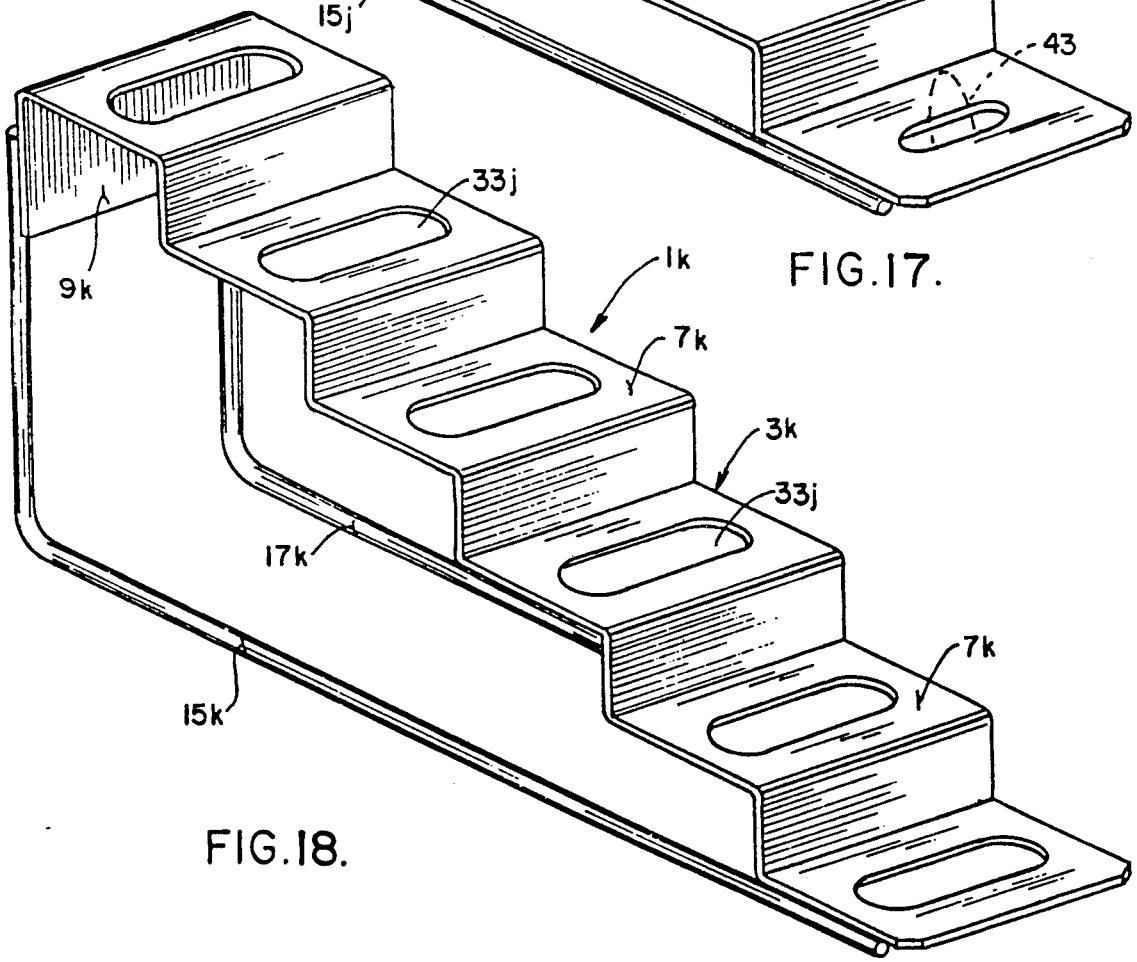
FIG. 18 is a side top perspective view of yet still another modified of multi-tiered rack for tools.

In the FIG. 18 embodiment, the rack 1*k* also includes only an upper-stepped section 3*k*, with elongated openings 33*j* being substantially larger in shape or size than the elongated opening 33*j* of the FIG. 17 embodiment.

Various racks shown in FIGS. 1–6 and 13–18 of the drawings accommodate a variety of tools including screwdrivers, pliers, punches, cold chisels, as well as heavier products such as arc joint pliers and vice grips, the latter being used in rack constructions such as in FIGS. 16-18 where the tools can rest directly on a supporting surface, instead of the upper and lower stepped sections as in the other embodiments.

With the exception of such aforementioned differences, the construction and use of the multi-tiered rack for tools shown in FIGS. 2–6 and 13–18 of the drawings conforms in all respects to the FIG. 1 and 7–12 embodiment, as will be appreciated.

In lieu of holes formed in one or both stepped sections, upstanding pins 43, shown in dotted lines in FIG. 17 of the drawings, may be used to engage certain types of tools, i.e., sockets, for supporting same relative to each stepped section. As such, such pins are known as tool supporting means for supporting tools relative to each stepped section in said multi-tiered rack. Similarly, the openings in each stepped sections, shown in the other embodiments, are also known as tool supporting means.

From the foregoing, it will now be appreciated that the multi-tiered rack for tools of the present invention provides a unique merchandising and display device for tools which eliminates the need for packaging, while also presenting the tools in an easily observable and ready to remove position for the retail customer.

In view of the above, it will be seen that the several objects and features of the present invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

What is claimed is:

1. A multi-tiered rack for tools comprising:

spaced upper and lower stepped sections each including interconnected alternating horizontal and vertical surfaces arranged in a stepped pattern;

structural connecting means supporting said spaced upper and lower sections in the aforementioned stepped pattern;

each horizontal surface in one of said upper and lower stepped sections being in aligned and substantially parallel relationship to a corresponding horizontal surface in the other of said upper and lower stepped sections;

each vertical surface in one of said upper and lower stepped sections being in generally aligned coplanar relationship with a corresponding vertical surface in the other of said upper and lower stepped sections; and tool openings formed in the horizontal surfaces of at least the upper horizontal surfaces of the upper and lower stepped sections for receiving tools therein to support same in said multi-tiered rack.

2. The multi-tiered rack as defined in claim 1 wherein the tool openings are formed in the horizontal surfaces of the upper and lower stepped sections, the tool openings in each aligned and substantially parallel upper and lower horizontal surface being in substantial register with one another.

3. The multi-tiered rack as defined in claim 2 wherein the tool openings in substantial register with one another in the upper and lower stepped sections are of the same general size and shape.

4. The multi-tiered rack as defined in claim 3 wherein there is at least one tool opening formed in each aligned and substantially parallel upper and lower horizontal surface.

5. The multi-tiered rack as defined in claim 4 wherein there are a plurality of openings in substantial register with one another in each aligned and substantially parallel upper and lower horizontal surface.

6. The multi-tiered rack as defined in claim 1 wherein the structural connecting means includes spaced wire elements joined to at least some of said interconnected alternating horizontal and vertical surfaces in each of said upper and lower stepped sections for supporting same in fixed relationship to one another.

7. The multi-tiered rack as defined in claim 6 wherein said spaced wire elements are joined to said upper and lower stepped sections at opposite ends thereof.

8. The multi-tiered rack as defined in claim 7 wherein said spaced wire elements each include a generally horizontally extending portion and upwardly extending portions at free ends thereof for attachment to aligned horizontal surfaces in the upper and lower sections at one end and to generally vertically aligned surfaces in the upper and lower sections at an opposite end thereof.

9. The multi-tiered rack as defined in claim 1 and further including means for attaching same to a display board.

10. The multi-tiered rack as defined in claim 7 wherein said attaching means is mounted to a generally oriented rear vertical surface which is connected to and extends transverse to the uppermost horizontal surfaces in the upper and lower stepped sections.

11. The multi-tiered rack as defined in claim 8 wherein said attaching means includes at least one display board fastening element for releasable attachment thereto.

12. The multi-tiered rack as defined in claim 9 including upper and lower display board fastening elements.

13. A multi-tiered rack for tools comprising:

at least one stepped section;

self-supporting structural connecting means for supporting said stepped section relative to a supporting surface and including spaced wire elements, said spaced wire elements each having a horizontally extending portion which rests on a supporting surface and at least one upwardly extending portion which extends upwardly to said stepped section at an upper end thereof, said spaced wire elements being interconnected to opposite upper and lower ends of said stepped section; and tool supporting means in each said stepped section for supporting tools relative to each said stepped section in said multi-tiered rack.

14. The multi-tiered rack as defined in claim 13 wherein said at least one stepped section includes step-ladder shaped individual sections mounted relative to said structural connecting means.

15. The multi-tiered rack as defined in claim 13 wherein said at least one stepped section includes interconnected alternating horizontal and vertical surfaces arranged in a stepped pattern, and said tool supporting means being formed in the horizontal surfaces thereof.

16. The multi-tiered rack as defined in claim 15 including spaced upper and lower stepped sections each including interconnected alternating horizontal and vertical surfaces arranged in a stepped pattern, and tool supporting means being formed in the horizontal surfaces thereof.

17. The multi-tiered rack as defined in claim 13 wherein said tool supporting means comprises at least one opening in each stepped section.

18. The multi-tiered rack as defined in claim 13 wherein said tool supporting means comprises at least one pin in each stepped section.

* * * * *